US005876018A

United States Patent [19]

Crisp et al.

[11] Patent Number: 5,876,018

[45] Date of Patent: Mar. 2, 1999

[54] IN-TRAIN WHEEL CHANGING DEVICE

[76] Inventors: Ian Crisp; Lou Laskis, both of 80 Saramia Crescent, Concord, Ontario, Canada, L4K 3Z8

[21] Appl. No.: 676,795

[22] Filed: Jul. 8, 1996

[51] Int. Cl.[6] ..... B66F 7/26

[52] U.S. Cl. ..... 254/33; 254/124

[58] Field of Search ..... 254/33–38, 122, 254/126, 45, 84, 85

[56] References Cited

U.S. PATENT DOCUMENTS

| | | | |
|---|---|---|---|
| 2,053,080 | 9/1936 | Henricks | 254/35 |
| 2,369,838 | 2/1945 | Minnis . | |
| 2,931,519 | 4/1960 | Beach | 254/9 R |
| 3,362,351 | 1/1968 | Robertson | 254/84 |
| 4,068,823 | 1/1978 | Belanger . | |
| 4,805,875 | 2/1989 | Jackson et al. . | |
| 4,903,946 | 2/1990 | Stark | 254/45 |
| 5,133,531 | 7/1992 | Grashoff et al. . | |

*Primary Examiner*—Robert C. Watson
*Attorney, Agent, or Firm*—Paul J. Field

[57] ABSTRACT

The invention provides a method of replacing the wheels of a railroad car while the railroad car is at rest on rail tracks. Most advantageously, the rail car need not be uncoupled from adjacent cars. The method also has the advantage that rail cars are jacked at the coupler thereby making the method applicable to all types of cars including grain and oil cars which cannot be jacked in their midsections. The method comprises the steps of: releasing the wheel to be replaced from the rail car; transverse insertion of a jack between the rails and the underside of the coupler; actuating the jack to lift the rail car supported upon the underside of the coupler; removing the wheel to be replaced; replacing the wheel; actuating the jack to lower the rail car onto the replaced wheel; securing the replaced wheel to the rail car. The invention also provides a jack for raising and lowering an end of a railroad car having a coupler extending therefrom, the railroad car being at rest on longitudinal rail tracks, the jack being disposed between the rails and the underside of a coupler, the jack comprising: a base supported upon the rails; a cap disposed in parallel above the base; coupler support means for supporting the rail car coupler upon the cap; and lifting means, disposed between the base and cap, for selectively raising and lowering the cap relative to the base between a collapsed position wherein the jack is clear of the rail car to facilitate transverse insertion between the rails and the underside of the coupler, and a maximum lift extended position. Advantageously the coupler support means comprise a travelling table means for shifting the coupler transversely thereby aligning the rail car wheel flanges on the rail head.

9 Claims, 9 Drawing Sheets

IN-TRAIN WHEEL CHANGING DEVICE

TECHNICAL FIELD

The invention is directed to a device for replacing the wheels of a railroad car by jacking between the rails and the underside of the rail car coupler to lift the rail car above the tracks. A particular advantage relates to use of the invention without the need to uncouple the rail cars of a complete train.

BACKGROUND OF THE ART

Railway car wheel maintenance poses several challenges. What is commonly called a "wheel" is in fact more accurately defined as a wheel assembly, which includes an axle with two flanged wheels press fit thereon. When an axle cracks or bends, the flanged wheels are damaged or require refinishing, a standard maintenance procedure is performed to remove the damaged wheel assembly and install a replacement.

Rail cars with damaged wheels may of course require maintenance anywhere along a railroad track. In some cases moving the rail car could be dangerous or inconvenient. In all cases the speed of the wheel change operation is important since a stationary rail car generates little revenue, and the damaged car may be blocking rail traffic. The location of the damaged rail car may be remote from repair facilities. The terrain adjacent the railway tracks is often very rough and access restricted.

Conventional responses to this problem have been partially successful. If the damaged car can be easily moved to a repair shed, a common solution is to lift the rail car with an overhead crane and then to replace the wheel. Often the time, cost and inconvenience involved in uncoupling the damaged car from a train, moving the car to a repair shed, and rerouting the freight, make this type of operation very unsatisfactory.

A preferred repair operation involves quickly replacing the damaged wheels of rail car while it rests on the rails without moving the rail car substantially. In emergency situations, rough terrain mobile cranes have been used to lift rail cars and perform repairs. Mobile cranes are expensive to operate and require large areas on or adjacent the tracks. The mobile crane must be transported to the site, and may require substantial labour and equipment to properly set up. It is unsafe to work close to or under a heavy load suspended by a crane and therefore safety concerns require that the rail car be securely positioned on blocks before workers can commence repairs.

Several systems have been introduced which use hydraulic jacks to lift the rail cars while they rest upon the rail tracks. Hydraulic jacks are relatively easy to transport and insert under rail cars. As well hydraulic jacks provide a stable base on which the car can rest during repairs.

Hydraulic jacks may be placed under the trucks of the rail car to lift the trucks off the damaged wheel. The jacks must be supported on blocks and levelled however increasing the repair time taken. A preferred method is to use the relatively level rail tracks for supporting jacks to lift the rail car. An example of one such system is described in U.S. Pat. No. 4,068,823 to Belanger.

Due to the limited space available under the rail car trucks, the lifting capacity and maximum lift of such jacks is severely limited. In short, the more space that is available, the larger the jack, and the higher and heavier the capacity of the jack. To replace a rail car wheel, the lifting height capacity of such systems is simply inadequate.

Boxcars and container rail cars have structural frames with longitudinal beams. These beams of the frame have sufficient strength that enable the rail car can be safely lifted by placing hydraulic jacks on the rail tracks for support and extending the jacks upward to lift under the beams.

Prior art devices include systems where hydraulic jacks are supported on the rails in the midportion of the rail car. The jack is extended upwards to engage the underside of the rail car beam or frame to lift the rail car. Examples of such systems are described in U.S. Pat. Nos. 4,805,875 to Jackson et al and 5,133,531 to Grashoff et al. There is ample space in the midportion of the car to utilize high lift capacity jacks, or as in the case of Grashoff, to position hydraulics outboard of the car.

A significant advantage of lifting in the midportion is realized when the jacks are used on articulated well cars. Whereas conventional cars have two trucks, one at either end of a rail car, well car trains are assembled from car platforms which share a common articulated track between them. The jack may be positioned in the midportion of one car to lift the car, an adjacent portion of the next car and shared truck off a damaged wheel. As such the jack is distant from the wheel and there is sufficient access space to replace the wheel.

Although well cars are used extensively for transporting containers and other specialty large height loads, they still represent only a fraction of the modem rail car traffic.

The obvious disadvantage of using a midsection lifting system is that it cannot be used on rail cars that do not have accessible structural frames or beams. Tanker rail cars are constructed as cylindrical tanks supported at their ends on trucks which are coupled together. Grain cars or ore cars often have hoppers, conveyor pipes, trapdoors and other hardware extending below the midportion of the car. Jacking in this area is either impossible due to insufficient structural strength, or is likely to damage such hardware. The acceptance of such midportion hydraulic lifting systems is severely limited since trains are generally assembled with an unpredictable variety of rail cars and a system that cannot be used on all cars of a train is less than ideal.

It is desirable therefore to produce a hydraulic lifting system that can be utilized regardless of the type of rail car or the nature of its structural frame. Ideally such a desired system would be easily transported and handled during the setup procedure.

It is also desirable to produce a lifting system which is simple to set up and does not require separation of the rail cars from an assembled train.

DISCLOSURE OF THE INVENTION

The invention takes advantage of the one feature that the majority rail cars have in common. No matter what structural characteristics, shape, or function a rail car has; no matter what hardware extends from the underside of the rail car; no matter who manufactured, purchased, maintained or operated the rail car; the majority of rail cars have identical couplers.

Since rail cars are designed to be universally coupled together into a train, highly uniform standardized couplers have been adopted. In fact there are in North America fewer than three manufacturers of couplers and all types are interchangeable. This feature is taken advantage of by the inventors to introduce a novel solution to the problem of railcar wheel replacement.

The invention provides a method of replacing the wheels of a railroad car by jacking under the coupler while the railroad car is at rest on rail tracks. The method has the advantage that rail cars are jacked at the coupler thereby making the method applicable to all types of cars including grain and oil cars which cannot be jacked in their midsections. The coupler acts as a cantilevered beam extending from all rail cars. The coupler has sufficient strength to support the weight of the rail car and has sufficient play in the engaging components of the coupler to prevent binding or excessive stress during lifting.

Most advantageously, the rail car with damaged wheels need not be uncoupled from adjacent cars. The jack is positioned under the centre of the couplers which join two adjacent rail cars. The couplers hold all of the rail cars in a train together during the entire lifting operation. Of course, the ends of the train are drawn inward slightly as the adjacent couplers of the raised cars are jacked upwardly. The remote couplers at the opposite ends of raised cars are forced downwardly slightly. However, such slight movements have been found to be inconsequential. Binding does not occur at the couplers nor are excessive stresses or deformations induced in any of the couplers or rail car components. The rail cars remain stable during lifting and the rail tracks provide an excellent substantially level base for the jack with no damage to the rails or rail bed.

The method of the invention comprises the steps of: releasing the wheel to be replaced from the rail car; transverse insertion of a jack between the rails and the underside of the coupler; actuating the jack to lift the rail car supported upon the underside of the coupler; removing the wheel to be replaced; replacing the wheel; actuating the jack to lower the rail car onto the replaced wheel; securing the replaced wheel to the rail car.

The invention also provides a jack for raising and lowering an end of a railroad car having a coupler extending therefrom, the railroad car being at rest on longitudinal rail tracks, the jack being disposed between the rails and the underside of a coupler, the jack comprising: a base supported upon the rails; a cap disposed in parallel above the base; coupler support means for supporting the rail car coupler upon the cap; and lifting means, disposed between the base and cap, for selectively raising and lowering the cap relative to the base between a collapsed position wherein the jack is clear of the rail car to facilitate transverse insertion between the rails and the underside of the coupler, and a maximum lift extended position. Advantageously the coupler support means comprise a travelling table means for shifting the coupler transversely thereby providing for alignment of the railcar wheel flanges on the rails.

Further details of the invention and its advantages will be apparent from the detailed description and drawings included below.

BRIEF DESCRIPTION OF THE DRAWINGS

In order that the invention may be readily understood, a preferred embodiment of the invention and variations thereof will be described by way of example, with reference to the accompanying drawings wherein.

DETAILED DESCRIPTION OF PREFERRED EMBODIMENTS

Figure 1:
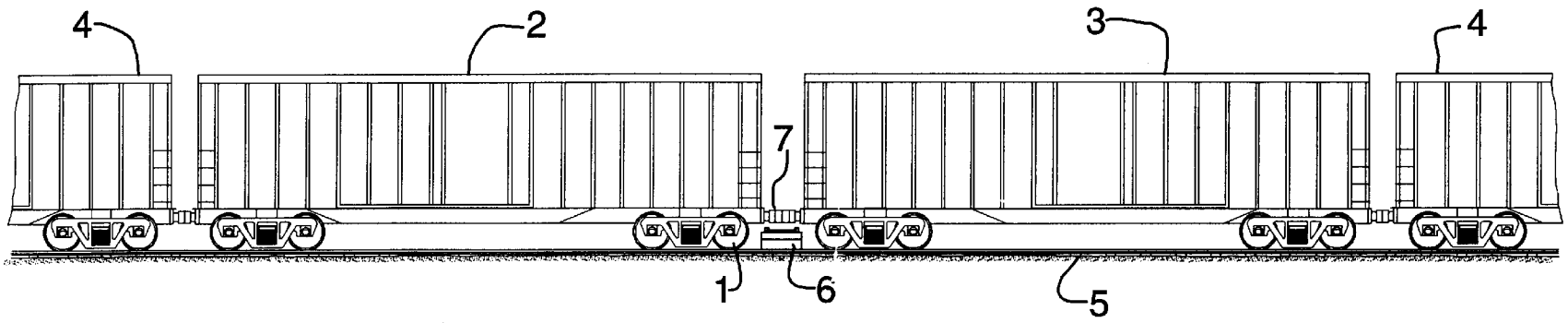
FIG. 1 is an elevation view of a complete train with a jack inserted for replacing the wheels of the railroad car left of centre by jacking between the rails and the underside of the rail car coupler to lift the rail car above the tracks.
Figure 2:
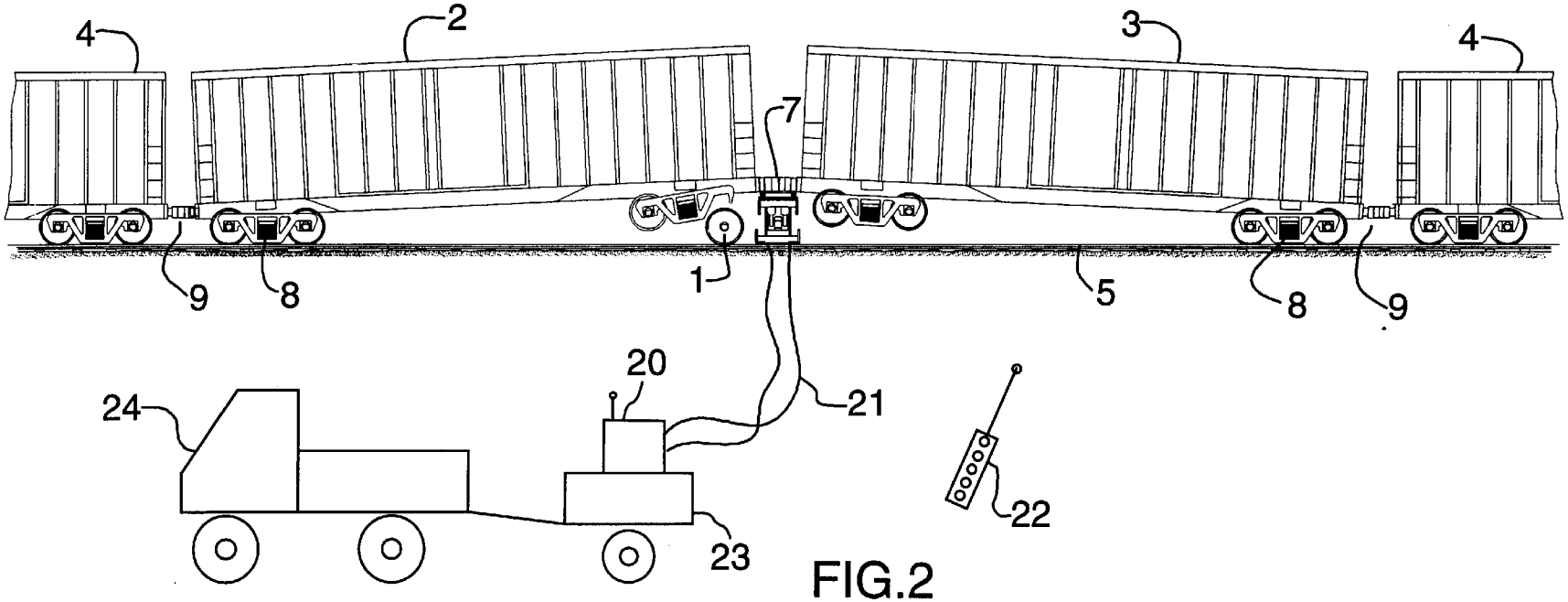
FIG. 2 is a like elevation view showing the rail car lifted and a wheel to be replaced remaining positioned on the rail, as well as the remotely controlled hydraulic power plant mounted to the trailer of an all terrain vehicle.

FIGS. 1 and 2 convey the novel but simple concept of the invention. In the example illustrated, a single defective wheel 1 of a rail car 2 requires replacement.

A dramatic advantage of the invention over prior methods is that the rail car 2 to be repaired need not be uncoupled from the rail car 3 immediately adjacent the damaged wheel 1 or any of the other rail cars 4 of the train. The repair operation can therefore be carried out quickly with minimal labour or disruption to rail traffic. Unlike prior art devices, the invention is applicable to any type of rail car 2 since the invention utilizes the common couplers 7.

In brief, to replace the defective wheel 1, while the railroad car 2 and remainder of the cars 3, 4 of the train rest on the longitudinal rail tracks, a jack 6 is inserted transversely between the rails 5 and the underside of the couplers 7. A rough terrain fork lift vehicle is generally used to place the jack 6 on the supporting rails 5.

The wheel 1 to be replaced is released from the rail car 2 by removing retaining bolts or other common restraints. In this way, as shown in FIG. 2, the defective wheel 1 is left resting on the tracks 5 while the other wheels of the rail cars 2, 3 are raised off the tracks 5 and remain secured to the rail cars 2, 3.

The jack 6 is actuated as in FIG. 2 to lift the rail car 2 which is supported upon the underside of the coupler 7. Preferably the jack 6 is hydraulically powered by an external power hydraulic source 20 connected to the jack 6 with hoses 21 and controlled remotely with a radio transmitter pendant 22. In the embodiment illustrated the power source 20 is mounted to the trailer 23 of an all terrain vehicle 24. The power source 20 includes a gasoline power engine, hydraulic pump and reservoir, manual override controls and radio controls. Various application may include different embodiments of the same inventive concept.

As shown in FIG. 2, the couplers 9 at the opposite ends of the lifted rail cars 2, 3 are forced downwardly as the rail cars 2, 3 rotate about the wheel truck 8 at the opposite end. Due to the relatively short lever arm distance between the opposite wheel truck 8 and the opposite end couplers 9, this downward movement is within tolerable limits and does not result in binding or excessive stress in the couplers 9. In practice it has been found that if the jack 6 is raised to a height of 64 inches, the opposite end couplers 9 are displaced a mere 4 inches.

The jack 6 includes a fail-safe mechanism which is actuated during lifting to prevent collapse of the jack 6 in the event of hydraulic failure under load. Using conventional devices attached to the forks of a forklift vehicle, the defective wheel 1 is removed and a replacement wheel 1 is placed on the tracks 5 in its place. The jack 6 is then actuated to lower the rail car 2 onto the replaced wheel 1. The replaced wheel 1 is secured to the rail car 2, and the repair operation is complete.

The above outline of the invention has been brief and appears deceptively simple. Numerous practical difficulties have been overcome by the inventors in bringing this basic procedure to a practical commercially viable embodiment.

A major difficulty relates to the extremely confined space available above the track 5, under the couplers 7 and laterally clear of the rail car wheels 1, ladders and other hardware. As explained in detail below, a preferred embodiment of the invention includes a compact folding scissor jack 6 powered by four hydraulic cylinders via a remotely controlled external hydraulic power source 20 mounted upon an all terrain vehicle 24. The low 16½ inch collapsed height, high lift capacity of 50 tons and 64 inch extended height of the jack present formidable technical challenges which have been overcome in a novel manner by the inventors.

The jack 6 itself has a lift capacity of 50 tons and a maximum extended height of at least 64 inches. A high lift capacity is required to allow sufficient clearance to remove and replace the wheel 1. The high weight capacity of 50 tons is required since, due to the outward positioning of the coupler 7 and rail car trucks 8, the jack 6 lifts slightly less than half the total weight of each rail car 2, 3 lifted. Due to the vertical clearance between the top of the rails 5 and the underside of the coupler 7, the collapsed height of the jack 6 is no more than 20 inches for most standard railcars and as little as 16½ in for some specialized cars. The width of the jack 6 is no more than 37 inches to clear the ends of the rail cars 2, 3 and to avoid crowding of the area around the wheels 1.

Figure 3:
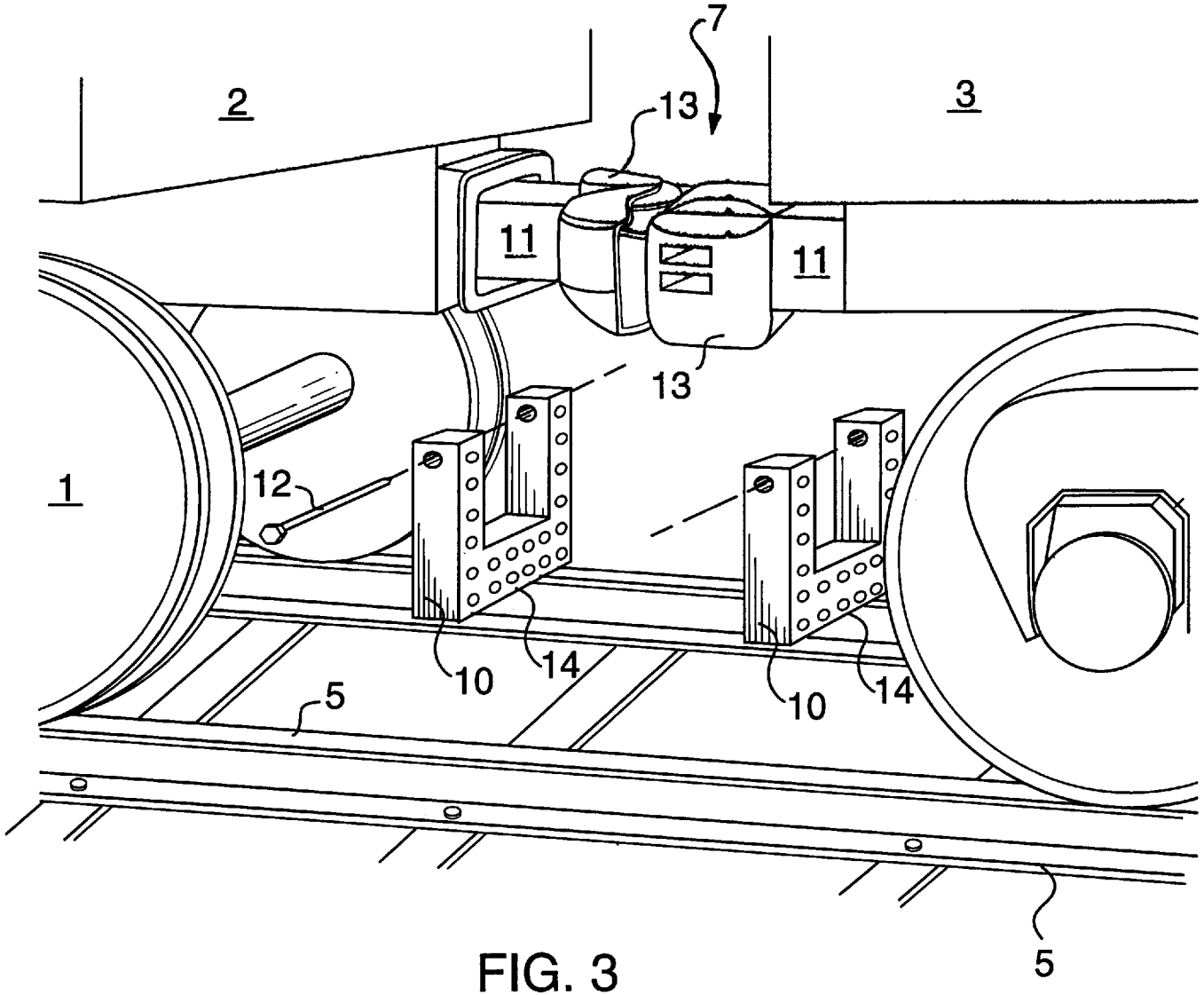
FIG. 3 is a perspective view of the coupler area between two adjacent rail cars showing an exploded view of the yoke cradles below the coupler shanks.

FIG. 3 shows the coupler area between adjacent rail cars 2, 3, with U-shaped cradling yokes 10 in position below the coupler shanks 11 on which they are to be secured. The initial step in the procedure is to manually position the cradling yokes 10 on the coupler shanks 11 and then secure the yokes 10 in position by inserting the removable transverse pin 12. The pin 12 spans between the upturned legs of the yoke 10 and rests upon the upper side of the coupler shank 11. The flat underside surface 14 of the yoke 10 provides means to support the coupler 7 on the top of the jack 6, while allowing clearance for the knuckle portion 13 of the coupler to shift or rotate during lifting.

It will be understood that the yokes 10 may be easily redesigned to suit any type of coupler shank 11. It is preferable to keep the load as close to the top of the jack 6 as possible for stability, however, the underside of the coupler knuckle 13 must not touch the jack 6 for proper operation and safe lifting. The dimensions of the yokes 10 may be modified to adapt the yokes 10 to various coupler 7 types or shank 11 dimensions. It is anticipated that due to standardization of railcar couplers 7, it will only be necessary to provide two or three different yokes 10 to accommodate the majority of the user's needs.

Figure 4:
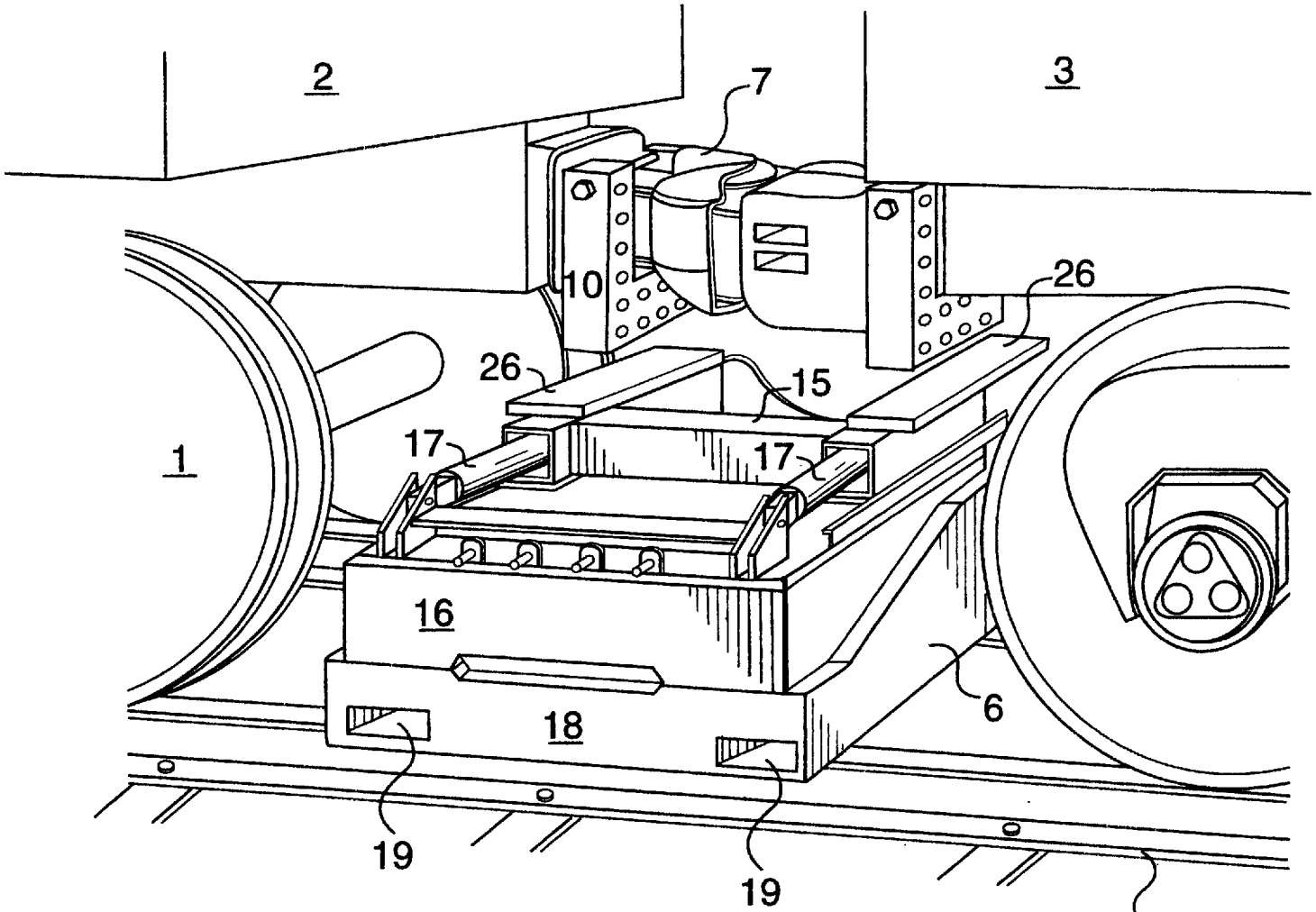
FIG. 4 shows a like view with the yokes attached to the coupler shanks and the jack in a collapsed position supported on the tracks beneath the couplers.

FIG. 4 shows the next step wherein the jack 6 in its collapsed position, clear of the rail cars 2, 3, is transversely inserted between the rails 5 and the underside of the coupler 7.

The jack 6 has a travelling table 15 with flat top surfaces 26 to engage the flat underside surfaces 14 of the yokes 10. FIGS. 4–13 relate to a first embodiment of the travelling table with a long stroke for extended table travel, whereas, FIGS. 14–15 show details of a second embodiment of the travelling table with a lower height and shorter travel stroke.

The travelling table 15 is used to shift the coupler 7 transversely relative to the rails 5 to align the rail car 2 on the replacement wheels 1 or to compensate for any movement during lifting. The table 15 structure is slideably disposed on the upper cap 16 portion of the scissor jack 6 and includes hydraulic cylinders 17 to actuate the table 15. Preferably the table has a transverse travel of at least 16 inches total, 8 inches to either side of the rail centreline. The arrows in FIG. 8 indicate the travel of the table 15 supported on the stationary jack 6.

Figure 11:
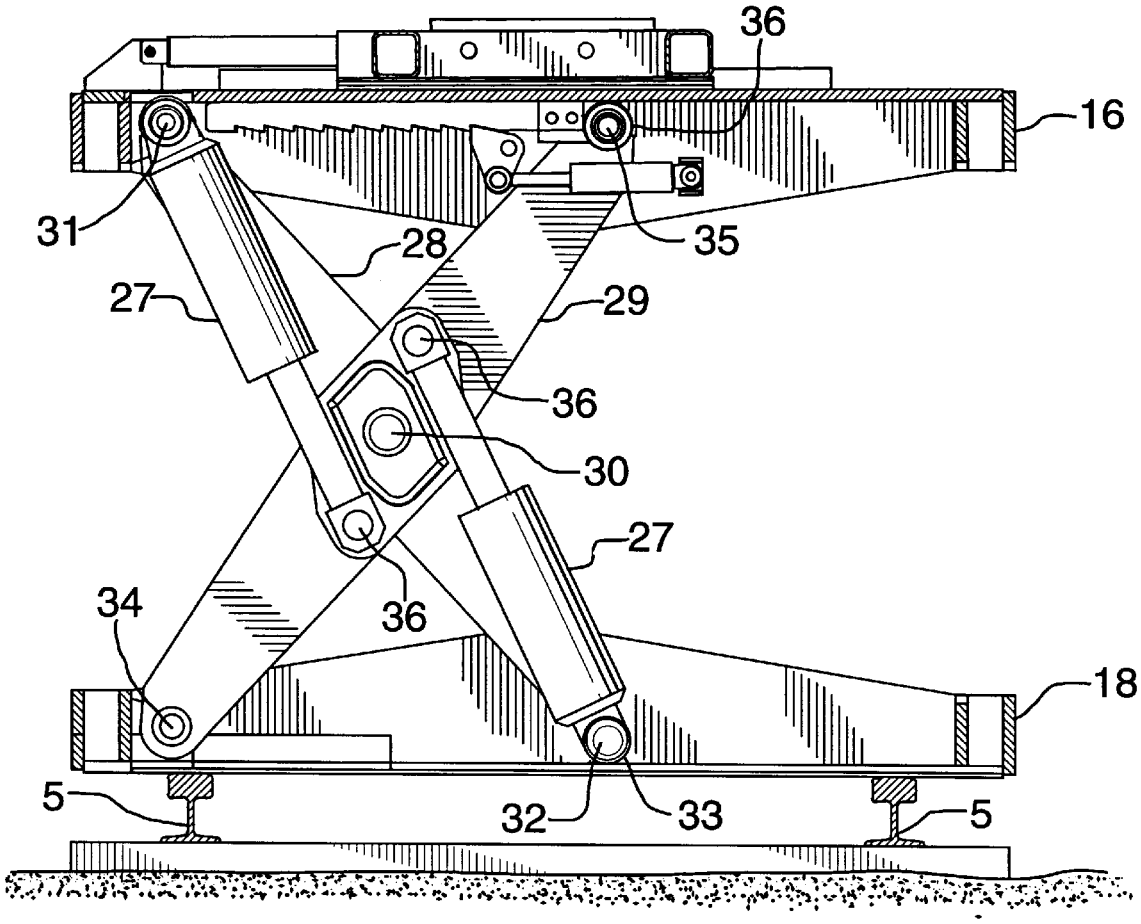
FIG. 11 is a sectional view of the jack in the extended position.
Figure 12:
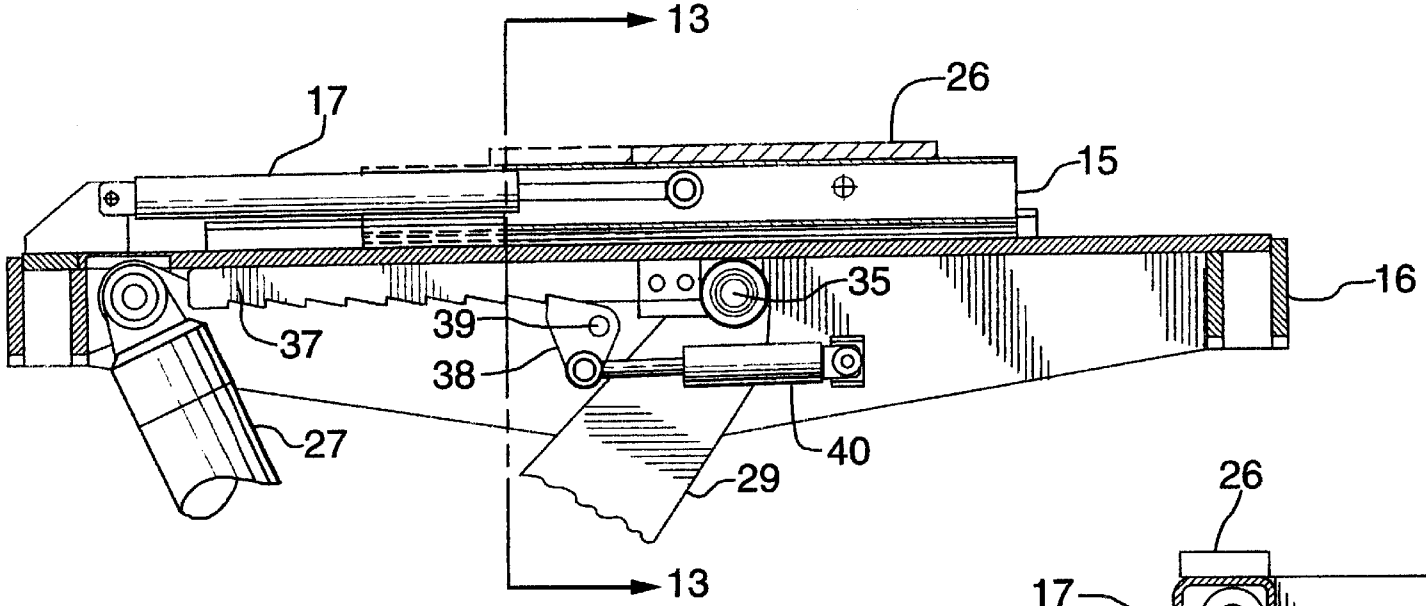
FIG. 12 is a sectional detail view of a first embodiment of the travelling table with a long stroke for extended table travel and showing details of the fail-safe rack-pawl mechanism.
Figure 13:
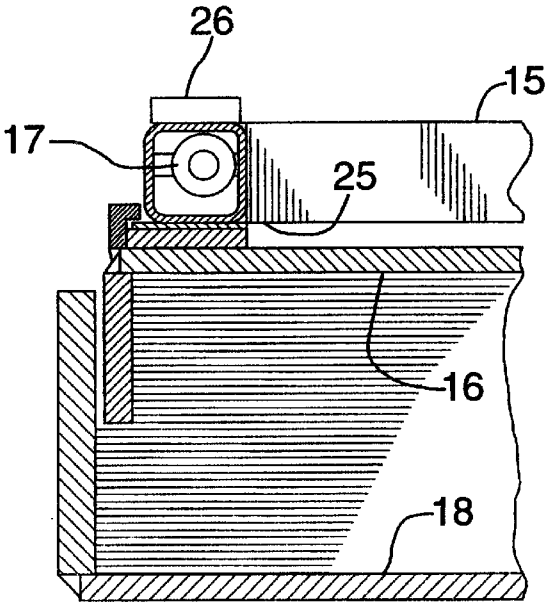
FIG. 13 is a sectional view along line 13—13 of FIG. 12.

FIGS. 11–13 show details of the first embodiment table 15 construction wherein the hydraulic cylinders 17 extend into the interior of hollow square steel structural sections to provide an extended cylinder 17 stroke and table 15 travel.

Figure 14:
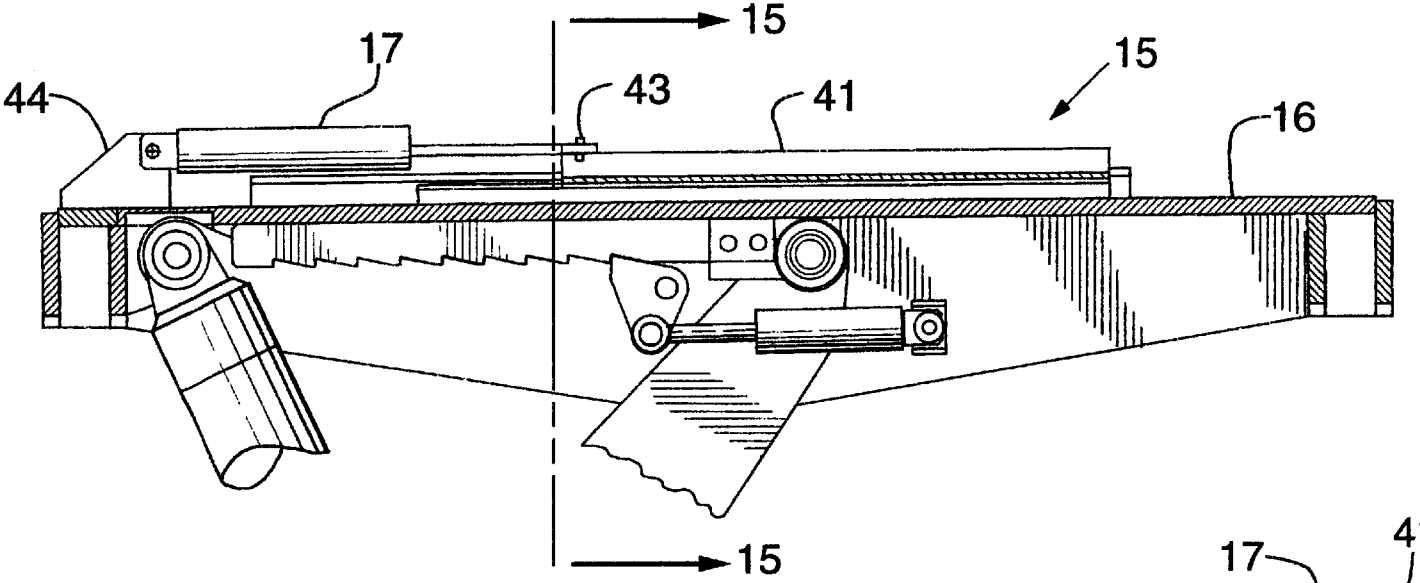
FIG. 14 is a sectional detail view of a second embodiment of the travelling table with a lower height and shorter travel stroke.
Figure 15:
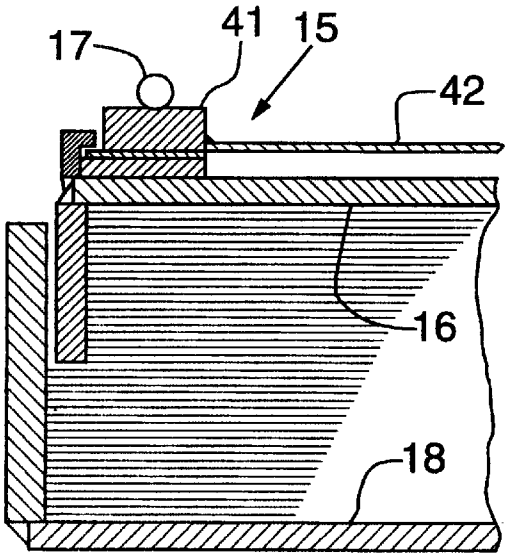
FIG. 15 is a sectional view along line 15—15 of FIG. 14.

FIGS. 14–15 show an alternate second table 15 embodiment which has a lower height to accommodate railcars with reduced distance between the rail 5 and underside of the couplers 7. The table 15 comprises two flat steel support plates 41, about 2 inches thick, slideably mounted on the upper cap 16 and with an upper surface for supporting the yokes 10. The support plates 41 are joined together with a web plate 42. The cylinders 17 are vertically pinned with a removable bolt 43 to the support plate 41 at one end and to a bracket 44 at the other. It will be understood that the cylinders 17 shown in FIGS. 14–15 are generally shorter than those in other Figures. Therefore the first and second table 15 may be removed and replaced merely by removing the pins holding the cylinders 17 to adapt the jack 6 to different coupler designs.

The scissor jack 6 has a base 18 which spans across the rails 5 and is supported in a substantially level position on the rail heads. The base 18 includes transverse fork lift slots 19 which extend substantially through the base 18 to enable accurate positioning with an all terrain forklift vehicle. Of course, a crane or other lifting device with a fork attachment could also be used, but to lesser advantage. The width of the base 18 and bending strength of the rails supported on sleepers ensures that no damage to the rails 5 occurs during lifting.

Figure 5:
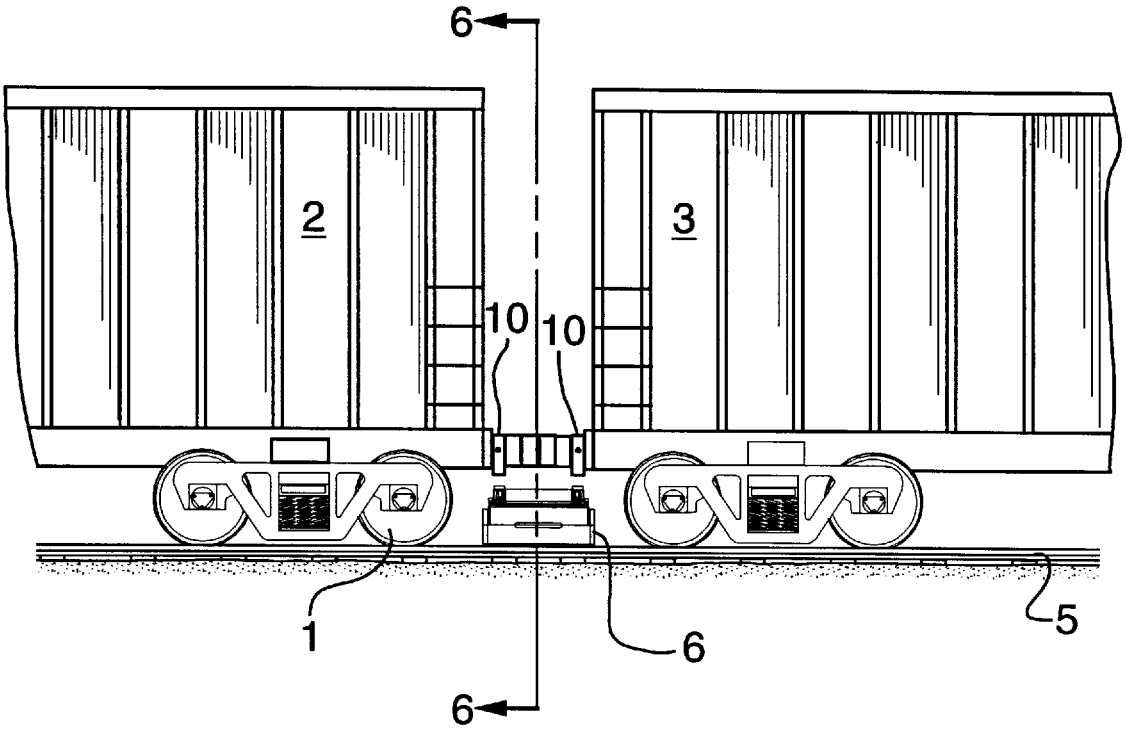
FIG. 5 shows an elevation view of the arrangement of FIG. 4.
Figure 6:
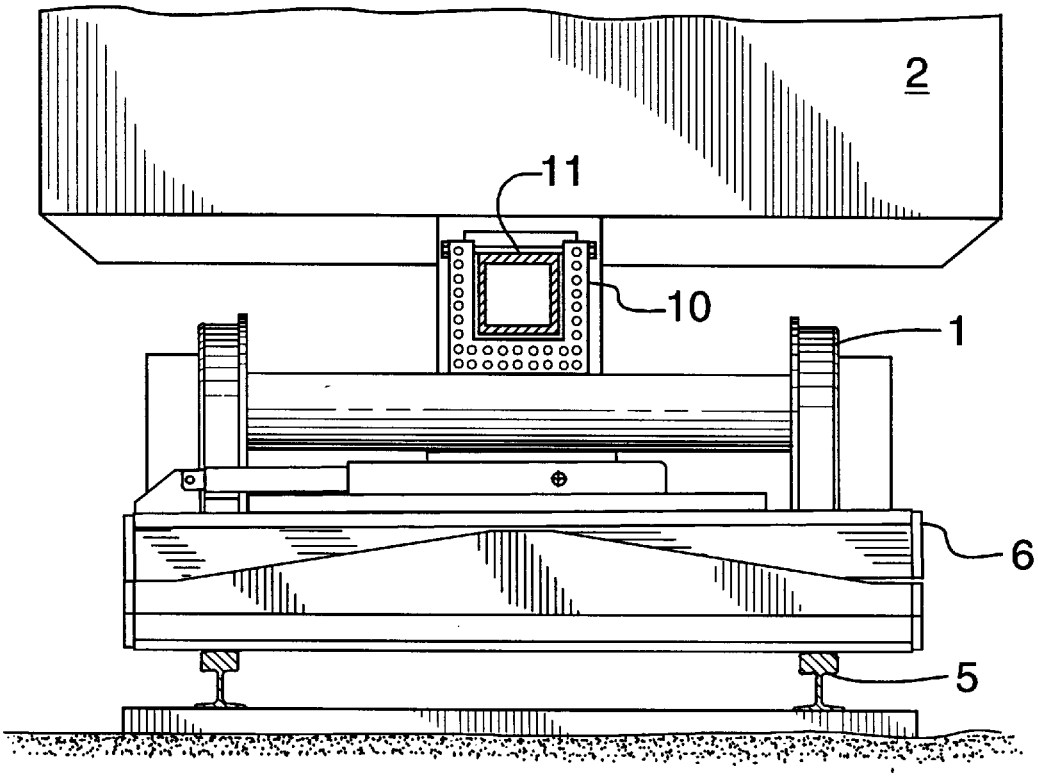
FIG. 6 shows a longitudinal sectional view along line 6—6 of FIG. 5.

For clarity, FIG. 5 shows an elevation view of the jack 6 in position below the yokes 10, and FIG. 6 shows a like sectional view.

Figure 7:
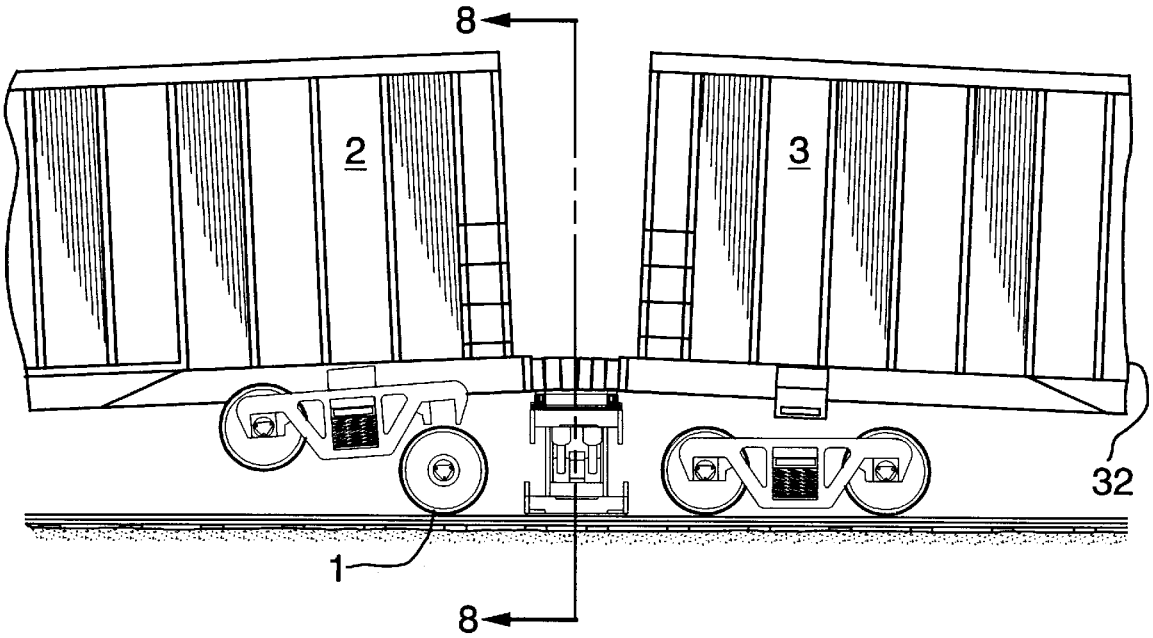
FIG. 7 shows a detailed elevation view of the raised rail cars similar to FIG. 2.
Figure 8:
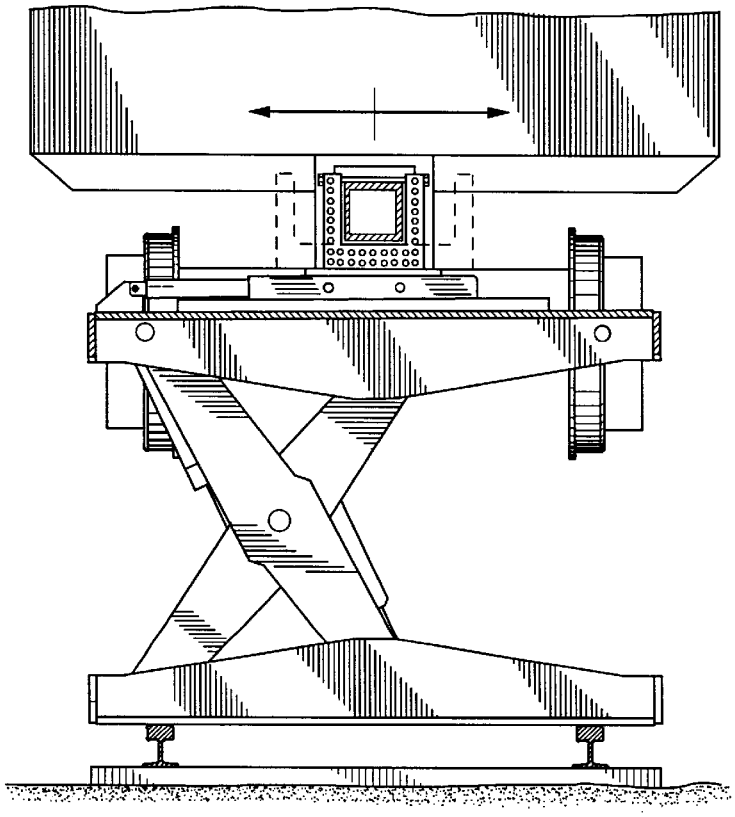
FIG. 8 shows a longitudinal sectional view along line 8—8 of FIG. 7.
Figure 9:
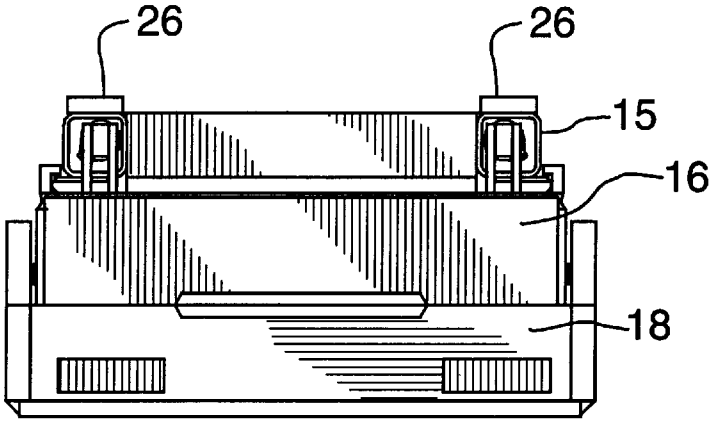
FIG. 9 is an end view of the jack in the collapsed position.
Figure 10:
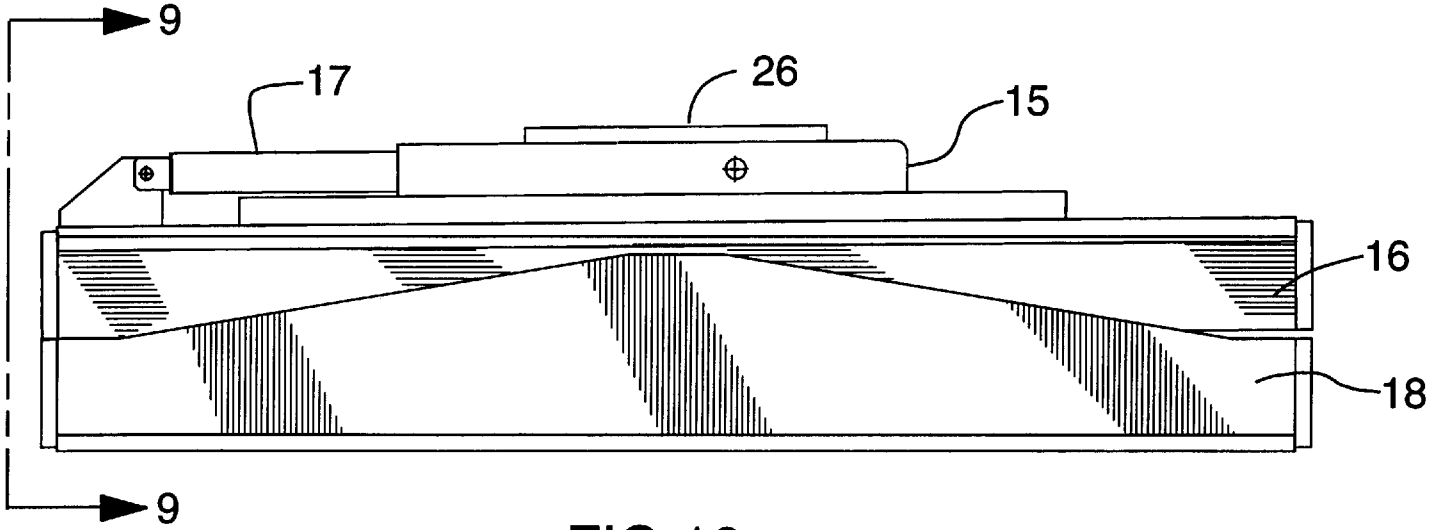
FIG. 10 is an elevation view of the jack in the collapsed position.

With the jack 6 in position, the wheel 1 to be replaced can be released from the rail car 2 by removing securing bolts or other mechanical restraints. The jack 6 is then actuated to lift the two rail cars 2, 3 supported on the underside of their couplers 7. The maximum lift extended position is shown in FIGS. 7 and 8, wherein the rail car 2 is lifted clear of the wheel 1.

The damaged wheel 1 is now able to be removed and replaced using conventional lifting devices. One common example is a pronged device which is fitted to the forks of a forklift truck. The device includes a lower abutment which engages the underside of the wheel 1 and an upper prong which grasps the wheel flange at the top edge. Such devices are known to those in the art and do not form part of the invention.

Once the wheel 1 is replaced, the operation is reversed by actuating the jack 6 to lower the rail car 2 onto the replaced wheel 1, and to replace the adjacent rail car 3 on the tracks 5. If necessary the travelling table 15 of the jack 6 is used to shift the couplers 7 and rail cars 2, 3 transversely relative to the tracks 5. Shifting may be required to align the wheels 1 on the tracks 5 or to fit the rail car 2 onto the replacement wheel 1 due to load shifting during the lifting operation.

FIGS. 9 to 13 show details of the construction and operation of the jack 6. In the collapsed position shown in FIGS. 9 and 10 the hydraulic components are protected within the interior of the base 18 and the cap 16 which is disposed in parallel above the base 18 and nests within the base 18 as indicated in FIG. 13. The cap 16 and base 18 are constructed of welded steel plates in the form of rectangular open boxes the long side walls of which are tapered from the maximum height at their midpoints.

As explained above, the couplers 7 are supported upon the cap 16 in the preferred embodiment upon yokes 10 which rest upon the top flat surfaces 26 of the sliding table 15. The table 15 may slide upon the cap 16 using greased machined surfaces 25, or on roller bearings. Hydraulic cylinders 17 actuate the table 15 to accurately position the rail cars 2, 3.

FIG. 11 shows the jack 6 in a maximum lift extended position. Four hydraulic cylinders 27 are disposed between the cap 16 and base 18 to selectively raise and lower the cap 16 relative to the base 18 resting on the rails 5.

A pair of scissor arms 28, 29 coact about a central scissor pin 30. The upper arm 28 is journaled to the cap 16 at a pinned pivot end with an upper axle 31, whereas the lower travelling pivot end of the upper arm 28 is mounted together with rollers 33 to a lower axle 32. The rollers 33 engage the base 18 as the cap 16 is raised or lowered. The lower arm 29 is journaled to the base 18 at a lower pinned pivot end 34, and has an upper travelling pivot end 35 with rollers 36 that engage the cap 16 as the cap is raised or lowered.

A scissor jack 6 requires at least one extendable hydraulic cylinder 27 to operate with one end journaled to the upper arm and another end joumaled to the lower arm axially spaced from the scissor pin 30. Due to the high load capacity of the illustrated application, the preferred embodiment includes a pair of first cylinders 27 mounted to the upper axle 31 and a pair of second cylinders mounted to the lower axle 32, with offset axles 36 axially spaced from the scissor pin 30 to journal the other ends of each hydraulic cylinder 27 to the lower arm 29.

FIG. 12 shows the details of the fail-safe mechanism provided to prevent collapse of the jack 6 in the event of hydraulic failure under load. The mechanism includes a rack 37 which is slideably housed within a slot in the cap 16 and is journaled to the upper end 35 of the lower arm 29. A pawl 38 is journaled to the cap 16 about pin 39. A spring loaded hydraulic cylinder 40 is provided to bias the pawl 38 into spring loaded engagement with the rack 37 at all times, and when actuated to release the pawl 38 from engagement during lowering of the jack 6. Preferably the hydraulic controls are configured to actuate the cylinder 40 automatically releasing the pawl 38 when the main cylinders 27 are actuated to lower the jack 6.

It is anticipated that a commercial embodiment of the invention may include different numbers of hydraulic cylinders 27, scissor arms 28, 29 or self contained power sources depending upon the lift capacity required and space available.

Although the above description and accompanying drawings relate to specific preferred embodiments as presently contemplated by the inventor, it will be understood that the invention in its broad aspect includes mechanical and functional equivalents of the elements described and illustrated.

The embodiments of the invention in which an exclusive property or privilege is claimed are defined as follows:

1. A jack for raising and lowering an end of a railroad car having a coupler extending therefrom, the railroad car being at rest on longitudinal rail tracks, the jack being disposed between the rails and the underside of a coupler, the jack comprising:

a base supported upon the rails, a cap disposed in parallel above the base;

coupler support means for supporting the rail car coupler upon the cap;

lifting means, disposed between the base and cap, for selectively raising and lowering the cap relative to the base between a collapsed position wherein the jack is clear of the rail car to facilitate transverse insertion between the rails and the underside of the coupler, and a maximum lift extended position wherein the lifting means comprise a pair of scissor arms coacting about a scissor pin, an upper arm of the pair journaled to the cap at a pinned pivot end and a lower travelling pivot end engaging the base, and a lower arm of the pair journaled to the base at a lower pinned pivot end and an upper travelling pivot end engaging the cap, each arm having an axis defined between their upper and lower pivot ends, and at least one extendible hydraulic cylinder having a first end journaled to the upper arm and a second end journaled to the lower arm axially spaced from the scissor pin; upper axle means for coaxially journaling the pinned pivot end of the upper arm and the first end of a first hydraulic cylinder to the cap; lower axle means for coaxially journaling the travelling pivot end of the upper arm and the first end of a second hydraulic cylinder together; and offset axle means for journaling the second end of each hydraulic cylinder to the lower arm axially spaced from the scissor pin.

2. A jack according to claim 1, wherein the coupler support means comprise a travelling table means for shifting the coupler transversely thereby aligning the rail car wheel flanges on the rails.

3. A jack according to claim 2, wherein the travelling table means comprise a table structure slideably disposed on the cap and actuator means for transversely actuating the table structure.

4. A jack according to claim 1, comprising fail-safe means for preventing collapse of the jack in the event of hydraulic failure under load.

5. A jack according to claim 4 wherein the fail-safe means comprise:

a rack slideably housed within the cap and journaled to the upper travelling pivot end of the lower arm;

a pawl journaled to the cap;

biasing means for biasing the pawl into engagement with the rack; and release means for releasing the pawl from said engagement.

6. A jack according to claim 1 wherein the base includes transverse slot means for engaging the forks of a forklift vehicle.

7. A jack according to claim 1 wherein the lifting means includes an external remotely controlled power plant.

8. A jack according to claim 1 wherein the coupler support means include a yoke cradle having a removable transverse pin spanning between upturned legs thereof, and a flat underside surface.

9. A jack according to claim 2 having:

a lift capacity of at least 50 tons;

a collapsed height between the rails and coupler of no more than 16½ inches;

a maximum extended height of at least 64 inches;

a width of no more than 37 inches; and a transverse travel of at least 16 inches.

* * * * *